US005499757A

United States Patent [19]

Back

[11] Patent Number: 5,499,757

[45] Date of Patent: Mar. 19, 1996

[54] EASY OPEN, TAMPER EVIDENT ENVELOPE

[75] Inventor: Gordon E. Back, Wallingford, Pa.

[73] Assignee: International Envelope Company, Exton, Pa.

[21] Appl. No.: 232,894

[22] Filed: Apr. 25, 1994

[51] Int. Cl.[6] ..... B65D 27/34

[52] U.S. Cl. ..... 229/81; 229/313; 383/5

[58] Field of Search ..... 383/5, 207; 229/80, 229/81, 313

[56] References Cited

U.S. PATENT DOCUMENTS

| | | | |
|---|---|---|---|
| 182,550 | 9/1876 | Booth | 229/81 X |
| 641,291 | 1/1900 | Hinchman | 229/81 |
| 2,001,340 | 5/1935 | Bear et al. | 229/80 |
| 2,056,132 | 9/1936 | Chadbourne | 229/80 |
| 2,083,158 | 6/1937 | Ramsey | 229/81 X |
| 2,129,705 | 9/1938 | Reineman | 229/81 |
| 3,520,472 | 7/1970 | Kukulski | 229/80 |
| 4,729,507 | 3/1988 | Kim | 229/313 X |
| 4,781,296 | 11/1988 | Morris et al. | 229/309 X |
| 4,998,666 | 3/1991 | Ewan | 383/5 X |
| 5,030,189 | 7/1991 | Hightower | 229/313 X |
| 5,077,001 | 12/1991 | Makowka | 383/5 |

*Primary Examiner*—Jes F. Pascua

*Attorney, Agent, or Firm*—Panitch, Schwarze, Jacobs & Nadel

[57] ABSTRACT

An easy opening, tamper evident package has a package body with a mouth opening to receive materials. A closure flap extends from the package body next to the mouth opening. The closure flap has an inner surface which faces and overlaps an edge portion of the package body when the closure flap is fully extended to close mouth opening. An adhesive closure is permanently adhered to the inner surface of the flap and has an adhesive surface which adheres to the edge portion, at least when said closure flap is fully extended over said mouth opening and pressed against said package body. A break-away region is defined in the package by perforations through the package body near the mouth opening. The adhesive closure overlaps the break-away region, at least when the closure flap is fully extended over said mouth opening to close the mouth so that the overlapped break-away region is subject to tear forces applied to the package to separate the closure flap from the adhered edge portion when the package is opened.

9 Claims, 1 Drawing Sheet

EASY OPEN, TAMPER EVIDENT ENVELOPE

FIELD OF THE INVENTION

The invention relates to the field of packaging and, in particular, to the field of packaging which is tamper evident.

BACKGROUND OF THE INVENTION

Spunbonded olefin sheet material is one material which is considered very desirable packaging material for numerous uses including envelopes, pouches, folders, sleeves, etc. Spunbonded olefin sheet material is relatively light in comparison to paper and other conventional packaging materials for its strength. One reason it is good for envelopes is its strength. Typically, paper weighing two to three times as much as spunbonded olefin sheet is required to provided comparable strength.

Many other features make it suitable for envelopes. The dense fiber network forming the sheet product offers extremely high resistance to tear, puncture and abrasion. Spunbonded olefin sheet has excellent resistance to waterborne soil and good resistance to degradation from age unless overly exposed to ultraviolet rays. It is inert to most acids and meets the requirements of the Federal Flame Fabrics Act. It is also unaffected by water or highly polar solvents and is therefore readily washable. Spunbonded olefin sheet is sold in different forms which have different characteristics in terms of tear strengths, tensile strengths, smoothness, porosity and flexibility and softness.

Hot-melt pressure sensitive adhesives are typically used with spun bonded olefin packages. The adhesive is applied directly to a package flap and a protective overlying release strip is applied as a protective cover. Such adhesives are very tenacious and stick firmly to the olefin sheet forming both the body and the flap. Because these adhesives are so tenacious, considerable force is required to separate the flap from body of the envelopes on which they are applied. This opening of the packages can be very difficult.

Typically, the opening of such a package results in a partial tearing away of filaments from the surface of olefin sheet and an extension from the surface of the olefin of the partially torn filaments. Additionally, some filaments are usually torn completely away from the surface of the olefin and adhered to the adhesive of the flap of the package. Furthermore, there is usually some stretching and wrinkling of the olefin material forming at least the flap of the package in the region of the adhesive. If an attempt is made to reseal such a package after an initial opening, the stretching and wrinkling of the flap and the relative ease with which the flap reopens due to the partial covering of the adhesive with broken olefin filaments provide a means by which it can be readily determined that the package was previously opened and resealed. Thus, olefin packages using hot-melt pressure sensitive adhesives were inherently tamper evident.

More easily opening closure systems using spunbonded olefin have been used as resealable packaging systems. One approach to making the resealable envelopes formed of this material was the use of mating flexible fabric fasteners such as Velcro®-type fastening members. The non-mating sides of these fastening members were permanently adhered to a body portion of an olefin packaging and to a flap or other closure portion of the olefin packaging. The engageable sides of the fabric fastening members matingly faced one another. However, this type of closure tends to be too thick, heavy and costly. Additionally, since this type of closure is not altered by the act of opening and closing, it is not tamper evident.

Another system for sealing envelopes formed of this material includes the use of identical polymer patches each bearing an identical adhesive on one side thereof which bonds well to both the olefin and to a polymer carrier carrying the adhesive. A first patch is applied to one surface of the packaging while a second patch is applied to the flap over an opening through the flap which overlies the first patch when the flap is applied to the one surface of the package. The opening through the flap is significantly smaller than the overall size of the patch applied to the flap. This insures that an adequate area of the flap is provided to secure the second patch and presents less than half of the adhesive surface of the second patch to engage with the underlying first patch mounted on the surface. In this way, a weaker bond is created between the second patch on the panel and the first patch on the packaging surface than is created between the second patch on the panel and the panel or between the first patch and the packaging surface. While this type of double patch system is useful in application requiring a number of opening and resealing operations, it too is not tamper evident.

It would be very desirable to provide permanently sealable yet easily openable packaging. Additionally, it would be desirable to provide easily openable packaging which is tamper evident.

SUMMARY OF THE INVENTION

In one aspect, the present invention is an easy opening, tamper evident package comprising a package body having a mouth opening to receive materials to be packaged within said package body and a closure flap which extends from said package body proximal said mouth opening. Said closure flap has an inner surface which faces and overlaps an edge portion of said package body when said closure flap is fully extended over said mouth opening and against the package body to close said mouth opening. Said package further comprises an adhesive closure adhered to one of said edge portion of the package body and the inner surface of the closure flap and having opposing surfaces which permanently bond with both said closure flap and said edge portion. A breakaway region is defined in said package by perforations through said package proximal said mouth opening. At least part of said adhesive closure overlaps at least part of said breakaway region at least when said closure flap is fully extended over said mouth opening and against said package body, whereby said overlapped breakaway region is subject to tear forces applied to said package to separate said closure flap from said adhered edge portion when said package is opened after said closure flap is sealed to said edge portion with said adhesive closure.

In another aspect, the invention is a tamper evident package comprising a package body having a mouth opening for permitting passage therethrough of materials to be packaged within said package body. Said package further comprises a closure flap having an inner facing side which overlaps said package body when said closure flap is extended over said mouth opening and pressed against said package body to close said mouth opening. Said closure flap has an adhesive surface upon said inner facing side defining a closure region upon said package body for permanently bonding with said closure region to secure said closure flap to said closure region when said closure flap is pressed against said package body. Said package body has perforations defining a breakaway region separating from a remainder of said package body when a tearing force is applied to said breakaway region. Said closure region and said breakaway region are in an overlapping relationship with each other for bonding said adhesive surface both to said breakaway region and to said remainder of said package body and for applying said tearing force to said breakaway region through said adhesive closure when said peeling force is applied to said closure flap, thereby separating said breakaway region from said remainder of said package body while peeling said closure flap from said package body around said breakaway region.

BRIEF DESCRIPTION OF THE DRAWINGS

The foregoing summary of the invention and the subsequent detailed description of preferred embodiments will be better understood when read in conjunction with the appended drawings. For the purpose of illustrating the invention, there is shown in the drawings, embodiments which are presently preferred. It should be understood, however, that the invention is not limited to the precise arrangements and instrumentalities shown. In the drawings.

DESCRIPTION OF PREFERRED EMBODIMENTS

Figure 1:
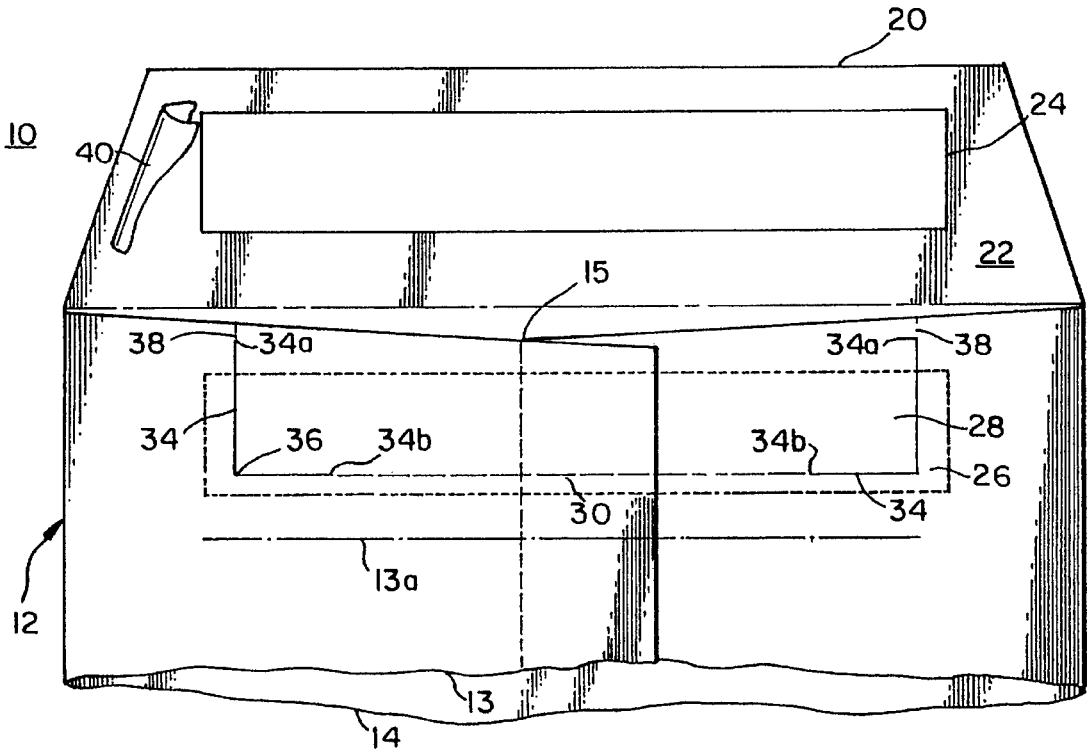
FIG. 1 is a cut away plan view of the mouth end of the easy opening tamper evident packaging of the present invention in the form of a tamper evident envelope in an open configuration.

Certain terminology is used in the following description for convenience only and is not limiting. The words "right," "left," "lower" and "upper" designate directions in the drawings to which reference is made. The words "inwardly" and "outwardly" refer to directions towards and away from, respectively, the geometric center of the device and designated parts thereof. The terminology includes the words specifically mentioned above, derivatives thereof and words of similar import.

In the drawings, like numerals are used to indicate like elements throughout.

There is shown in the figures one form of tamper evident packaging according to the present invention, namely an easy open envelope indicated generally as 10. Preferably, the easy open envelope 10 is preferably formed from one piece of spunbonded olefin sheet which is folded and bonded together in a conventional fashion to form a normally flat body 12. The normally flat body 12 is defined by a pair of juxtaposed major sides or panels 13 and 14. Panels 13, 14 are joined on three of their four sides and open on the fourth side to define a mouth opening 15. A closure flap 20 extends integrally from the one end of the body 12 proximal the mouth opening 15 on one side, the panel 14 side, of the mouth opening 15. The edges of the spunbonded olefin material overlap in a region 11 of the panel 13 where they are preferably bonded by a conventional hot melt pressure sensitive adhesive well known to those skilled in the art. Cold setting adhesives might be used although they are generally inferior to hot melt adhesives for adhering spunbonded polymeric sheet. Compared to such hot melt adhesives, cold setting adhesives have lower shear and peel strengths and require greater set-up times. The remaining end of the envelope 10, which is not depicted, can be permanently closed in a conventional fashion by providing a flap sealing together the remaining ends of panels 13 and 14.

Figure 2:
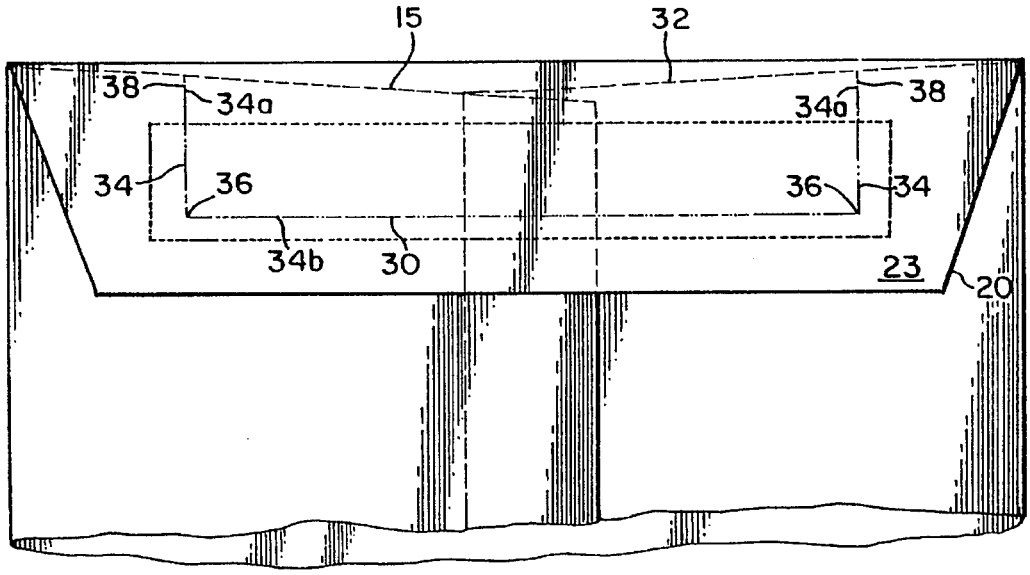
FIG. 2 is a cut-away plan view of the mouth end of the easy opening tamper evident envelope of FIG. 1 after closure.

In the preferred embodiment, the closure flap 20 is merely an extension of the panel 14 beyond the end of panel 13. The closure flap 20 has an inner surface 22 seen in FIG. 1 and an opposing, outer surface 23 seen in FIG. 2. The inner surface 22 faces and overlaps an edge portion of the body 12 at the top of the second panel 13. The edge portion **13*a* is bounded by mouth opening 15 and the broken line which is also identified by reference numeral 13*a* as seen in FIG. 1. When the closure flap 20 is fully extended over the mouth opening 15 and folded against the panel 13 of the body 12 so as to cover the mouth opening 15 and close the envelope 10, the region from the mouth opening 15 to the broken line 13*a* is covered by the closure flap 20**.

One of the closure flap 20 and edge portion **13*a*, preferably the closure flap 20, is provided with an adhesive closure 24. However, the adhesive closure 24 could be provided on the remaining one of the two, namely the outer surface of edge portion 13*a* of panel 13, proximal the mouth opening 15. The adhesive closure 24 is preferably a single layer of hot melt adhesive which effectively has two opposing surfaces which bond essentially permanently with the material forming an inner surface 22 of the closure flap 20 extending from the panel 14 and the material forming the outer surface of the panel 13. Preferably, the adhesive closure 24 defines a closure region 26, which is indicated diagrammatically by a surrounding dotted line on panel 13 in FIG. 1, when the closure flap 20 is fully extended over the mouth opening 15 and pressed against the panel 13 to cover the mouth opening 15 and seal the easy open envelope 10**.

The adhesive closure 24 may be provided with a release strip 40 of a material which does not bond particularly well with the exposed, facing side or surface of the adhesive closure, as opposed to the bond which develops between the adhesive closure and the material of closure flap 20 upon which the adhesive closure 24 is permanently adhered. The release strip 40 thus protects the closure 24 from inadvertently sticking to other surfaces and things and from contaminants until the release strip 40 is removed from the flap 20 to expose an adhesive surface of the closure 24 on the inner surface 22 of the flap 20.

The bond between the adhesive closure 24 and the closure region 26 of the panel 13 should be strong and permanent enough to maintain the closure flap 20 against the panel 13 and maintain the envelope 10 in a tightly closed state when the envelope 10 is subjected to the most strenuous kind of handling, which may occur during shipment of the envelope 10. Additionally, the bond should be strong enough to separate some surface material from the panel 13 or the closure flap 20 or both when the closure flap 20 is peeled away from the panel 13 after it has been sealed to the edge portion of the panel 13 with the adhesive closure 24. Preferably, a conventional hot-melt pressure-sensitive adhesive used to join the edges of the spun bonded olefin material forming the envelope 10 in the overlap region 11 of the panel 13 is used for this purpose as well.

The foregoing properties of the adhesive closure 24 can make this type of envelope difficult and inconvenient to open. An important aspect of the present invention is defining a breakaway region in the envelope 10 along at least part of the mouth opening 15 by the provision of perforations through the package 10 or other lines or regions of structural weakness in order to facilitate the opening of the envelope 10. In the preferred embodiment, the material of the panel 13 of the easy open envelope 10 has the breakaway region 28. The breakaway region 28 is preferably defined by a series of perforations 30 through the panel 13 which permit the breakaway region 28 of the panel 13 to be separated from the remainder of the panel 13, when a tearing force is applied to the breakaway region 28, more easily than the unperforated package material can be torn and more easily than the package material can be separated from the adhesive closure. Thus, the closure flap 20 may be more easily separated from the panel 13 when the envelope 10 is opened because the breakaway region separates from the body with less force than is required to strip the adhesive from the package material.

Preferably the breakaway region 28 of the easy open tamper evident envelope 10 is located on the panel 13 along the mouth opening 15 so that the edge 32 of the panel 13 forms one boundary of the breakaway region 28. Additionally, the breakaway region 28 is located on the panel 13 so as to be overlapped by the closure region 26, and thus with the adhesive closure, which makes contact with and permanently bonds with the closure region when the closure flap 20 is fully extended over the mouth opening 25, folded and pressed against the panel 13 of body 12 to close the mouth opening. In this manner, when the adhesive closure 24 on closure flap 20 bonds with panel 13, it bonds with at least some portion of the panel 13 which is inside and thus part of the breakaway region 28 and, typically, with portions of panel 13 which are outside and thus are part of the remainder of the body adjoining the breakaway region 28 as well. In particular, it is strongly desired that the adhesive closure 24 surround and overlap the two corners 36 of the breakaway region 28 away from mouth edge 32.

When the closure flap 20 is separated from the panel 13 by a peeling force applied to the closure flap 20, the peeling force is effective to separate the adhesive closure 24 from the regions of the panel 13 outside the breakaway region 28 generally by tearing surface material of the package adhering to the adhesive closure 24. However, the bonding strength of the adhesive closure 24 and the parameters of the breakaway perforations 30 are selected such that the force required to separate the closure flap 20 or the breakaway region 28 from the adhesive closure 24 is greater than the breakaway force needed to break the remaining bridges of package material between perforations 30, which couple the breakaway region 28 to the remainder of the panel 13 of the body 12. Thus, the adhesive closure 24 does not separate from the portion of panel 13 which is within the breakaway region 28 and the breakaway region 28 is tearingly separated from the remainder of the panel 13.

It will be understood that the breakaway perforations 30 defining the breakaway region 28 include a series of slits through the material forming the panel 13 such that the slits are separated by intervening bridge elements of package material extending unbrokenly between the breakaway region 28 and the remainder of the panel 13. In the preferred embodiment of the invention, the breakaway region 28 is further provided with two corner slits 34 extending continuously over paths which are ninety degrees in sweep in the indicated embodiment entirely around the opposing corners 36 of the breakaway region 28 located farthest from (i.e. distal to) the mouth 15. Each slit 34 is thus a continuous bent cut which extends from the slit end **34*a* to the slit end 34*b*. When a corner of the sealed closure flap 20 is peelingly separated from the panel 13 during opening of the envelope 10, a corner 36 of the region 28 adhered to the closure flap 20 is more easily lifted away from the remainder of the panel 13 because no bridge elements are provided in the corners 36, which must be broken. While cuts entirely through the package material are disclosed, the corners 36** could be defined in other ways such as by extreme thinning of the package material through melting, partial cutting, etc. along right angle, quarter circle or other bent paths.

Easy separation of the corners 36 of the breakaway region 28 facilitates the breaking away of the remainder of the breakaway region 28 from panel 13. In the preferred embodiment of the easy open envelope 10, there is only one bridge element 38 beyond the respective slit ends **34*a* on each of the left and right sides of the breakaway region 28. Bridge elements 38 should be far enough away from the corners 36 of the breakaway region 28 and from one another that the peeling force applied to the closure flap 20 is transmitted to successive individual bridge elements 38 rather than as a tensile force to a series of bridge elements acting in unison. The most advantageous arrangement of bridge elements is one wherein a bridge element 38 is broken before any bridge elements on the lower or distal border of the breakaway region 28 are broken in order to concentrate the tearing force on a single bridge element 38 and better initiate separation of the region 28 when a corner of the closure flap 20 is peelingly separated from the panel 13**.

In a preferred embodiment of the envelope 10 the material forming the spunbonded sheet of body 12 may be a Type 1056/D or 1070/D Tyvek® material, manufactured by E. I. dupont de Nemours & Co. of Wilmington, Del. The hot-melt adhesive might be, for example, an adhesive #80-8473 of United Resin Products, Inc. of Brooklyn, N.Y. The release strip might be, for example, a stock 30 ksia of Tekkote, Moonachie, N.J., which is a 30 lb. weight paper base with a silicone treatment on one side.

While the presently preferred embodiment of the invention is an easy open tamper evident envelope, the use of the invention is not limited to envelopes nor is it limited to spun bonded olefin. It is intended to cover all types of packaging such as paper, plastics including other types of spunbonded and even film polymers, and composite and laminate materials. The invention is suitable for packaging including, but not limited to pouches, folders, sleeves, boxes, clothing, etc. and other types of compatible material and packaging which may otherwise benefit from the present invention whether formed of spunbonded olefin material, other spunbonded or otherwise non-woven plastic sheet or any other suitable material. While a particular envelope and adhesive closure configuration is disclosed, others are possible. For example, multiple separate adhesive closures may be provided instead of a single central closure. One or more of the multiple adhesive closures may be made tamper evident in accordance with the present invention or in other ways known to make such packaging tamper evident, such as, for example, by the use of state or appearance changing adhesive closures. Additionally, perforated regions in accordance with the present invention may be formed in a variety of geometric shapes in addition to the rectangular shape depicted and may be formed manually or automatically by machine.

While preferred embodiments of the present invention have been disclosed in various modifications, still further modifications will occur to those of ordinary skill in the art. The present invention is not limited to the specific preferred embodiments or the specific possible modifications, but rather is defined by the appended claims:

I claim:

1. An easy opening, tamper evident package comprising:

a spunbonded olefin sheet package body having a mouth opening to receive materials to be packaged within said package body;

a spunbonded olefin sheet closure flap extending from said package body proximal said mouth opening, said closure flap having an inner surface which faces and overlaps an edge portion of said package body when said closure flap is fully extended over said mouth opening and pressed against said package body to close said mouth opening;

a hot melt adhesive closure permanently adhered to one of said edge portion of said package body and said inner surface and having an adhesive surface facing a remaining one of said closure flap and said edge portion at least when said closure flap is fully extended over said mouth opening and against said package body; and a breakaway region defined in said package by a continuous line of openings through said package proximal to said mouth opening, at least part of said adhesive closure overlapping at least part of said breakaway region at least when said closure flap is fully extended over said mouth opening and against said package body, whereby said overlapped breakaway region is subject to tear forces applied to said package to separate said closure flap from said adhered edge portion when said package is opened after said closure flap is sealed to said edge portion with said adhesive closure, said continuous line of openings defining at least three sides of the breakaway region and said openings being spaced sufficiently closely to one another along the line that a tear force required to break bridges of the spunbonded olefin sheet left between adjoining openings of the line is less than a tear force required to separate at least one of the closure flap and the breakaway region from the hot melt adhesive closure.

2. The easy opening, tamper evident package of claim 1, wherein said breakaway region is defined at least in part by perforations in said package body.

3. The easy opening, tamper evident package of claim 1, wherein said breakaway region is disposed along at least a part of said mouth opening.

4. The easy opening, tamper evident package of claim 2 wherein a pair of corners of said breakaway region are defined by a pair of continuous bent cuts through the package body, ends of the continuous cuts being connected by a line of perforations defining a side of the breakaway region between the continuous cuts.

5. An easy opening, tamper evident package, comprising:

a spunbonded olefin package body having a mouth opening for permitting passage therethrough of materials to be packaged within said package body;

a spunbonded olefin closure flap having an inner facing side which overlaps said package body when said closure flap is extended over said mouth opening and pressed against said package body to close said mouth opening;

said closure flap having a hot melt adhesive surface upon said inner facing side defining a closure region upon said package body for permanently bonding with said closure region to secure said closure flap to said closure region when said closure flap is pressed against said package body;

said package body having a continuous line of openings defining at least three sides of a breakaway region separating from a remainder of said package body when a tearing force is applied to said breakaway region, a remaining fourth side of the breakaway region being defined by an edge of the mouth opening and the continuous lines of openings including at least two continuous bent cuts defining at least parts of three sides of the breakaway region other than the side defined by the edge of the open mouth, the openings being spaced sufficiently closely along the line that said tearing force required to break bridges of the spunbonded olefin left between adjoining openings of the line is less than a peeling force required to separate the package body and the closure flap being held together by the hot melt adhesive surface; and said closure region and said breakaway region being in an overlapping relationship with each other for bonding said adhesive surface both to said breakaway region and to said remainder of said package body and for applying said tearing force to said breakaway region through said adhesive closure when said peeling force is applied to said closure flap thereby separating said breakaway region from said remainder of said package body while peeling said closure flap from said package body around said breakaway region.

6. The easy opening, package of claim 5, wherein said closure flap is integral with said package body.

7. The easy opening, package of claim 6, wherein said adhesive closure is in the vicinity of said mouth opening.

8. The easy opening, package of claim 6, comprising an envelope in which said package body and said closure flap are formed from a single piece of spunbonded olefin sheet folded and bonded to form a flat body of two juxtaposed panels, and said closure flap extends integrally from said package body on one side of said mouth.

9. The envelope of claim 8 wherein a pair of corners of said breakaway region are defined by a pair of continuous bent cuts through the package body.

* * * * *